US009221266B2

(12) United States Patent
Wood et al.

(10) Patent No.: US 9,221,266 B2
(45) Date of Patent: Dec. 29, 2015

(54) FLUID FLUX CORRECTION

(75) Inventors: Benjamin H. Wood, San Diego, CA (US); Jon A. Crabtree, San Diego, CA (US); Orestes Alejandro Bihun, San Diego, CA (US); Lawrence E. Gibson, San Diego, CA (US); Louis C. Ramsay, San Diego, CA (US); John M. Watanabe, San Diego, CA (US)

(73) Assignee: Hewlett-Parkard Development Company, L.P., Houston, TX (US)

( * ) Notice: Subject to any disclaimer, the term of this patent is extended or adjusted under 35 U.S.C. 154(b) by 0 days.

(21) Appl. No.: 14/371,952

(22) PCT Filed: Jan. 13, 2012

(86) PCT No.: PCT/US2012/021188
§ 371 (c)(1),
(2), (4) Date: Nov. 10, 2014

(87) PCT Pub. No.: WO2013/105968
PCT Pub. Date: Jul. 18, 2013

(65) Prior Publication Data
US 2015/0116429 A1 Apr. 30, 2015

(51) Int. Cl.

| | |
|---|---|
| ***B41J 2/17*** | (2006.01) |
| ***B41J 2/175*** | (2006.01) |
| ***B41J 2/055*** | (2006.01) |
| ***B41J 2/155*** | (2006.01) |

(52) U.S. Cl.
CPC *B41J 2/175* (2013.01); *B41J 2/055* (2013.01); *B41J 2/155* (2013.01); *B41J 2/17513* (2013.01); *B41J 2/17553* (2013.01); *B41J 2/17556* (2013.01); *B41J 2202/19* (2013.01); *B41J 2202/20* (2013.01)

(58) Field of Classification Search
CPC ..... B41J 2/17556; B41J 2/14451
See application file for complete search history.

(56) References Cited

U.S. PATENT DOCUMENTS

| | | | |
|---|---|---|---|
| 5,409,134 | A | 4/1995 | Cowger et al. |
| 6,293,666 | B1 | 9/2001 | Mou et al. |
| 6,296,353 | B1 | 10/2001 | Thielman et al. |
| 6,739,710 | B2 | 5/2004 | Lin et al. |
| 6,739,712 | B2 | 5/2004 | Kim |
| 7,429,093 | B2 | 9/2008 | Shinkawa |
| 7,984,975 | B2 | 7/2011 | Silverbrook |
| 2002/0039530 | A1 | 4/2002 | Taneya et al. |
| 2002/0186278 | A1 | 12/2002 | Nakamura et al. |
| 2004/0150699 | A1 * | 8/2004 | Feliciano ..... 347/86 |

(Continued)

FOREIGN PATENT DOCUMENTS

| | | |
|---|---|---|
| CN | 1243066 | 2/2000 |
| CN | 2400277 | 10/2000 |
| CN | 101405143 | 4/2009 |

(Continued)

OTHER PUBLICATIONS

International Search Report for International Application No. PCT/US12/21188, Mar. 10, 2014, 3 pp.

*Primary Examiner* — Geoffrey Mruk
(74) *Attorney, Agent, or Firm* — Trenner Law Firm, LLC

(57) ABSTRACT

Fluid flux correction is disclosed. An example method of fluid flux correction includes displacing a fluid volume in a fluid reservoir with a compliant element. The method also includes absorbing fluid surges caused by variations in fluid flux to reduce distortion of at least one ink nozzle meniscus and maintain consistent fluid ejection.

18 Claims, 8 Drawing Sheets

(56) References Cited

U.S. PATENT DOCUMENTS

| | | | |
|---|---|---|---|
| 2007/0222829 | A1 | 9/2007 | Stathem |
| 2011/0080447 | A1 | 4/2011 | Seshimo |

FOREIGN PATENT DOCUMENTS

| | | |
|---|---|---|
| JP | 2005254565 | 9/2005 |
| TW | 577822 | 3/2004 |

* cited by examiner

FLUID FLUX CORRECTION

BACKGROUND

Achieving consistent and quality output during a print operation is one of the most challenging aspects of printer development. Consistent print quality becomes more challenging when a multi-die print head is used, such as those used for Page Wide Array (PWA) printing.

A thermal inkjet drop-on-demand print head may operate under sustained periods of variable ink flux. Often, the print head rapidly transitions from an inactive state (no printing) or less active state where little or no ink is used, to an active state where large volumes of ink are consumed. These transitions can cause non-uniform volumes of ink to be output by the nozzles. When the volume of ink feeding individual the nozzles does not accelerate or decelerate sufficiently fast to match output at the nozzle, the nozzle meniscus can be distended or retracted as compared to the nominal state. The result is often varying ink drop attributes, such as drop volume, drop speed, and drop direction. Under some printing conditions, this can result in unacceptable printing artifacts.

DETAILED DESCRIPTION

Figure 1:
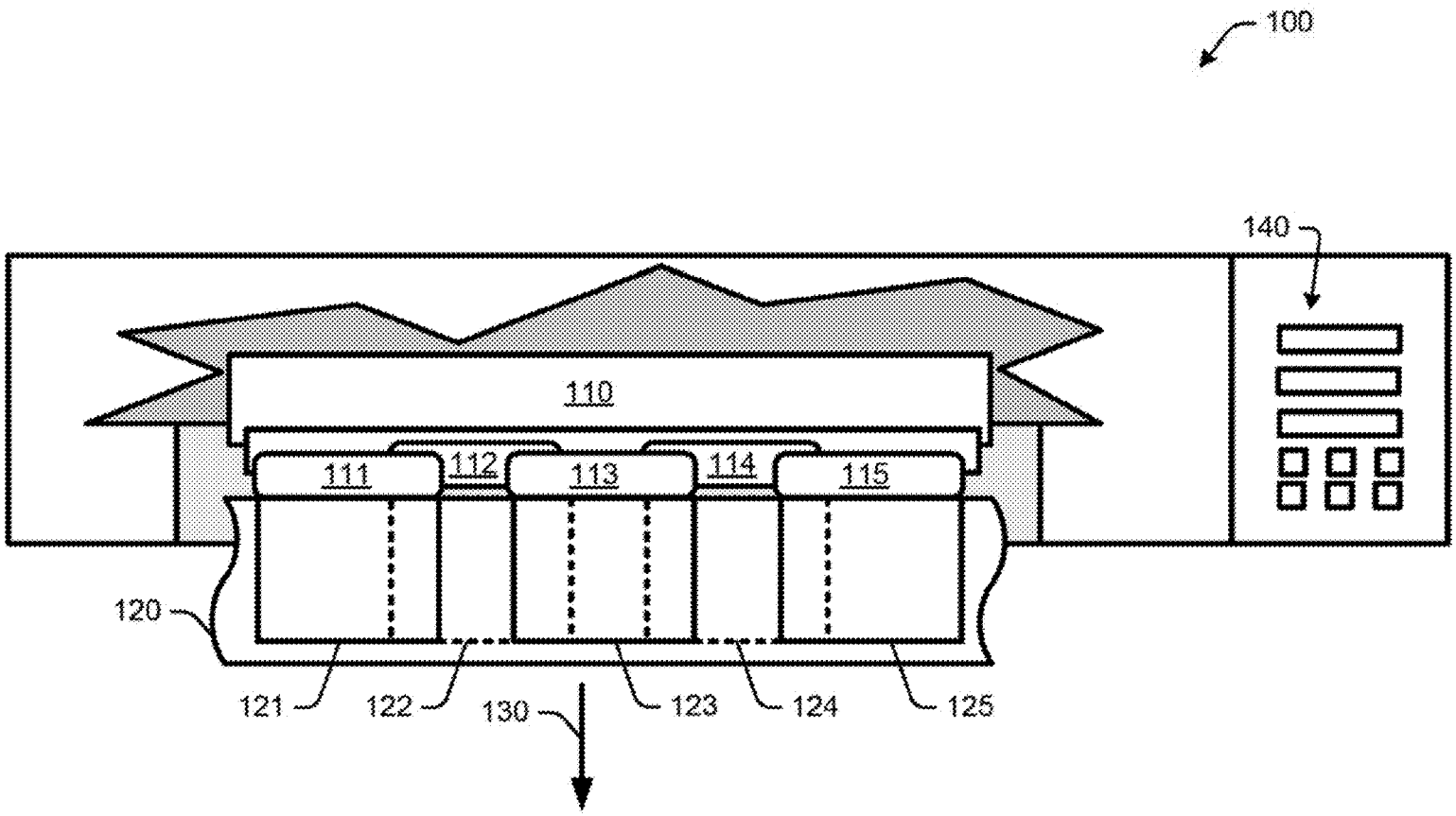
FIG. 1 is a high-level depiction of an example printer system.

Fluid flux correction is disclosed, which may apply generally to any fluid ejection operations, for example, to reduce inertia effects. For purposes of illustration, the fluid flux correction examples are described with regard to a print head with ink flux correction, and systems and methods relating thereto are disclosed. However, the fluid flux correction is not limited to implementation in print systems.

As noted above, under print conditions where the bulk of ink feeding individual nozzles does not accelerate or decelerate sufficiently fast to match the nozzle output, the meniscus of the nozzle can be affected, for example, distended (bulging) or retracted as compared to a nominal state. This disturbance of the meniscus is a result of "reverberation" or "inertial" ebb and flow, and the resulting effects on drop size and ejection during printing operations can cause undesirable print quality, such as unwanted artifacts on the printed media.

Piezoelectric printers use a kapton-like (polyimide) window film to isolate "piezo" movement in the bulk ink. But this is not a viable option for use with thermal inkjet drop-on-demand print heads because of the high nozzle density and size of the print head structure. Such an attempt would risk fracturing and failure of the ink containment integrity due to mechanical impact such as a paper crash.

Desktop inkjet printers may use a free air bubble within the pen body, in proximity to the nozzles. But this is not a viable option for use with thermal inkjet drop-on-demand print heads because of the high volumes of ink used. The bubble can increase in size as the ink degasses during heating. Significant accumulation of gasses from degassing can block ink channels in the print head and starve the nozzles of ink, leading to a system failure. Similarly, this attempt cannot be used with a degassed ink (such as those available to reduce the accumulation of air in the pen body of desktop inkjet printers), because the air bubble would eventually dissolve into the ink and the benefit would thus be lost.

Other attempts have focused on tuning the fluidic architecture by adjusting the bore shape, the nominal drop volume, and the nominal drop velocity to increase robustness of the drop ejection. But the printers are still subject to the undesirable effects of variable ink flux. Slowing the media speed, passing the media under the print zone multiple times, and depleting the content all reduce throughput performance (i.e., the number of pages that can be printed per minute), and thus are also undesirable attempts to correct for variations in ink flux.

The fluid ejection device (e.g., print head) disclosed herein introduces a compliant element in the fluidic path of the fluid (e.g., ink) in proximity to the ejection nozzles that serves to increase capacitance of the fluid or ink reservoir. As such, the nozzle menisci no longer have to provide all the capacitance (e.g. by bulging inward or outward) in response to sudden changes in fluid demand during ejection (e.g., a printing operation). Instead, during a sudden increase or decrease in fluid demand, the compliant element absorbs variations in fluid flux and reduces total distortion of the nozzle menisci, and thus helps to maintain drop ejection uniformity (within an acceptable range).

It will be appreciated that the compliant structure described herein may be fully contained within the ink containment boundary. As such, the compliant structure does not compromise the fluidic integrity of the print head, even if the compliant structure deteriorates or otherwise fails.

Figure 1A:
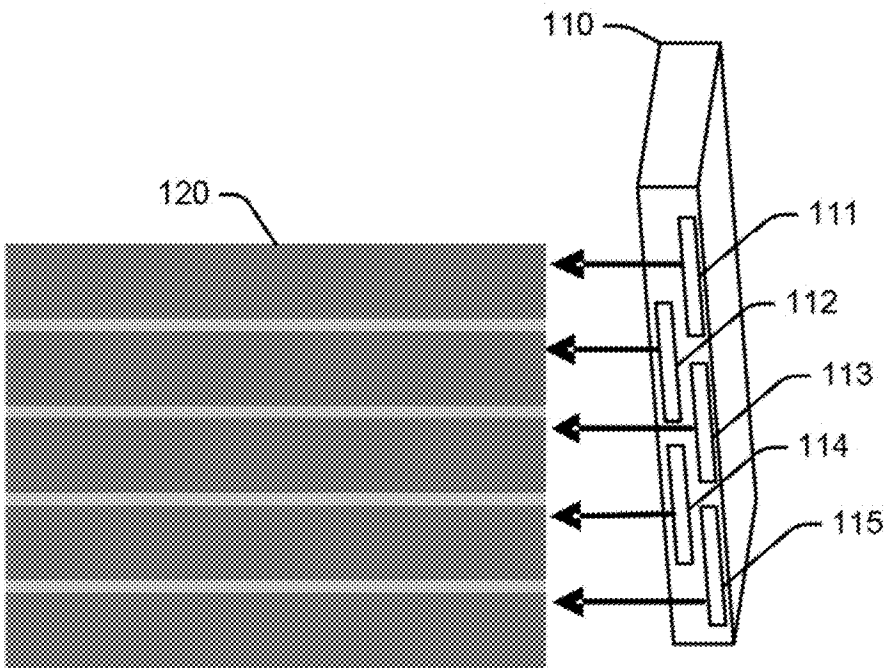
FIG. 1*a* illustrates an example print operation.
Figure 1B:
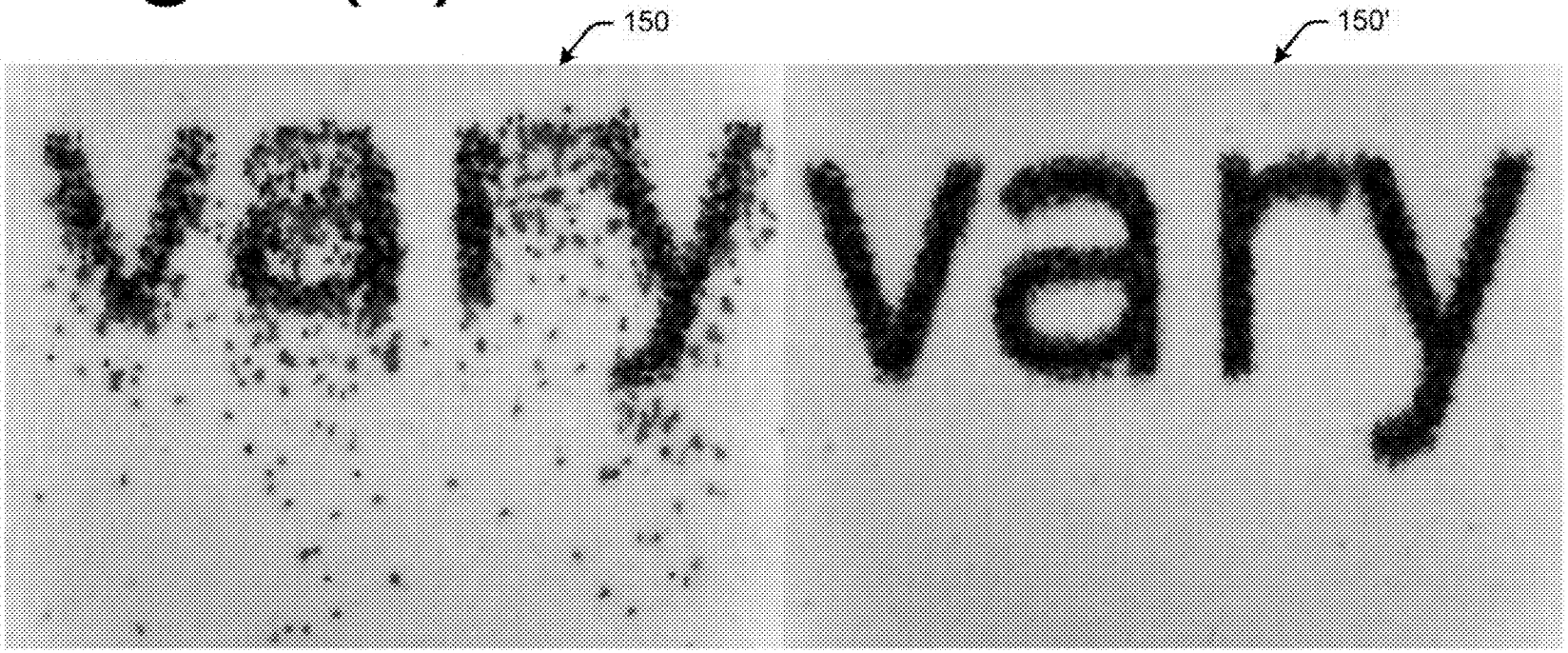
FIG. 1*b* shows example output from print operations.

FIG. 1 is a high-level depiction of an example printer system 100, such as the print head disclosed herein may be used with. FIG. 1*a* illustrates an example print operation. FIG. 1*b* shows example output from print operations. Example printer system 100 may be a PWA color inkjet printer with thermal inkjet drop-on-demand print heads, such as those commercially available from Hewlett-Packard Co. (Palo Alto, Calif.). The print head disclosed herein may also be used with other suitable printers now known or later developed, as will be readily appreciated by those having ordinary skill in the art after becoming familiar with the teachings herein.

An external control panel 140 may be provided for input/output by a user. The printer system 100 may also be operatively associated with an external device (not shown), such as a computer or other electronic control device for input/output operations. An internal control system (not shown) may be operatively associated with a driving mechanism (not shown) to pull a print media 120 from two reels (not shown) and move the print media 120 adjacent the print head 110 in the direction illustrated by arrow 130. The controller may also be operatively associated with one or more ink reservoirs fluidically connected to the print dies 111-115 to control the flow of ink for transfer onto the print media 120 (e.g., as illustrated in FIG. 1 by image portions 121-125 corresponding to print dies 111-115, respectively, on print media 120).

It is noted that the construction and operation of printer systems described above are well understood in the computer and printer arts and therefore further description is not necessary for a full understanding of the systems and methods described herein.

Printer system 100 may include one or more print heads such as print head 110 provided over a print media 120 (e.g., paper) as the print media 120 is fed through the printer (e.g., in the directions illustrated by arrow 130). Print head 110 may be a multi-die print head having print dies 111-115 in fluid communication with a fluid reservoir for supplying ink to the print dies 111-115. It is noted, of course, that print head 110 is not limited to any particular number or arrangement of print dies. The configuration shown in FIGS. 1 and 1*a* are merely illustrative of an example print head.

During a printing operation, ink is delivered from the ink reservoir in the print head 110 to the print dies 111-115 and ejected onto the print media 120, as illustrated in FIG. 1*a*. Under print conditions where the bulk of ink feeding individual nozzles does not accelerate or decelerate sufficiently fast to match the nozzle output, the meniscus of the nozzle can be distended or retracted (as compared to a nominal, concave state when the meniscus is at rest). These effects are referred to generally herein as inertia or inertance effects on drop quality, and can be caused by way of illustration, by sustained periods of high ink flux and transitions from no printing to high flux to low flux (and combinations thereof). This disturbance (distendence/retraction) of the meniscus (each meniscus may be adversely affected) during print operations can cause variations in ink drop characteristics, such as drop volume, drop speed, and/or drop direction.

By way of illustration, at rest a nozzle meniscus is naturally concave, as the internal pressure is set to stay below ambient pressure to avoid leaking. If at the time of firing, a nozzle has a meniscus extending beyond the equilibrium level, the ejected drop weight can be larger than average, the drop velocity can be slow, excess ink can puddle onto the nozzle bore surface absorbing drops entirely or pulling them off the intended trajectory. If at the time of firing, a nozzle has a meniscus retracted below the equilibrium level, the ejected drop weight can be smaller than average, the drop velocity can be fast, the drop shape can become more like a spray of many small drops rather than one coherent drop.

It can be readily appreciated that characteristics of the ink drops from each print die 111-115 can affect print quality on the print media 120. Variations in ink drop characteristics can affect consistent print quality on the print media, as seen in the sample 150 shown in FIG. 1*b*. The printed sample 150 is an example of undesirable print quality, including unwanted artifacts on the printed media, such as may be present when using a conventional print head.

At rest, a nozzle meniscus is naturally concave, as the internal pressure is set to stay below ambient pressure to avoid leaking. If at the time of firing, a nozzle has a meniscus extending beyond the equilibrium level, the ejected drop weight can be larger than average. In addition, the drop velocity can be slow, and excess ink can puddle onto the nozzle bore surface absorbing drops entirely or pulling them off the intended trajectory.

If at the time of firing, a nozzle has a meniscus retracted below the equilibrium level, the ejected drop weight can be smaller than average, the drop velocity can be too fast, and the drop shape can become more like a spray of many small drops rather than one coherent drop.

Once the critical meniscus distortion is exceeded, the specific issues are highly dependent on what was printed and what is being printed by other areas of the same print head assembly. By way of example, resulting print artifacts may include fuzzy text, banding, and incomplete area fill.

The printed sample 150' shown in FIG. 1*b* (compare with printed sample 150) is an example of output when using ink flux correction during printing operations. Ink flux correction may be achieved by introducing a compliant element in the fluidic path of the ink in proximity to the ejection nozzles on the print head 110, to increase the total capacitance of the ink reservoir. In an example, the compliant element is disposed in the ink reservoir itself, as discussed in more detail below with reference to the drawings shown in FIGS. 2 and 2*a*. The compliant element is configured to absorb ink surges caused by variations in ink flux during print operations.

As a result of the compliant element disposed in the ink reservoir of the print head 110, the nozzle menisci no longer have to provide all the compliance in the case of sudden changes in demand for ink. Instead, the compliant element absorbs variations in ink flux to reduce total distortion of each meniscus during a sudden increase or decrease in ink demand. The compliant element serves to reduce distortion of the ink nozzle meniscus. Thus, the compliant element maintains drop characteristics during ejection of the ink from the print head nozzles within an acceptable range. The compliant element enhances performance of each nozzle in the print head 110, independent of variations in ink flux. The compliant element also maintains performance of adjacent print head nozzles, and performance of the print head as a whole.

Before continuing, it is noted that the systems and methods described herein are not limited to the printer system 100 and calibration system 150 described above with reference to FIGS. 1 and 1*a*, respectively. Other printer systems and embodiments of the calibration system which may benefit from implementation of the described systems and methods will be readily appreciated by those having ordinary skill in the art after becoming familiar with the teachings herein.

Figure 2:
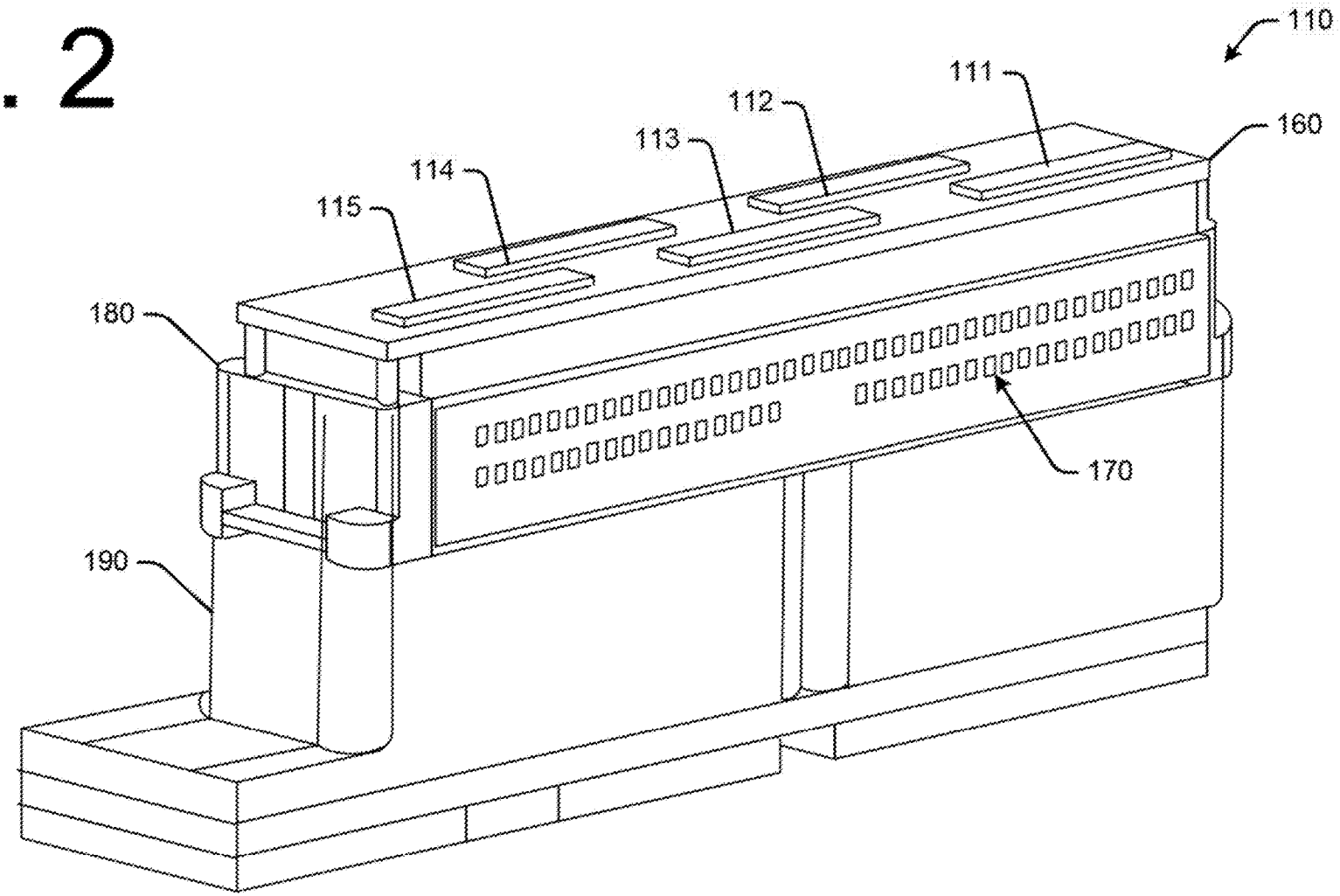
FIG. 2 is a perspective view showing the example print head in more detail.
Figure 2A:
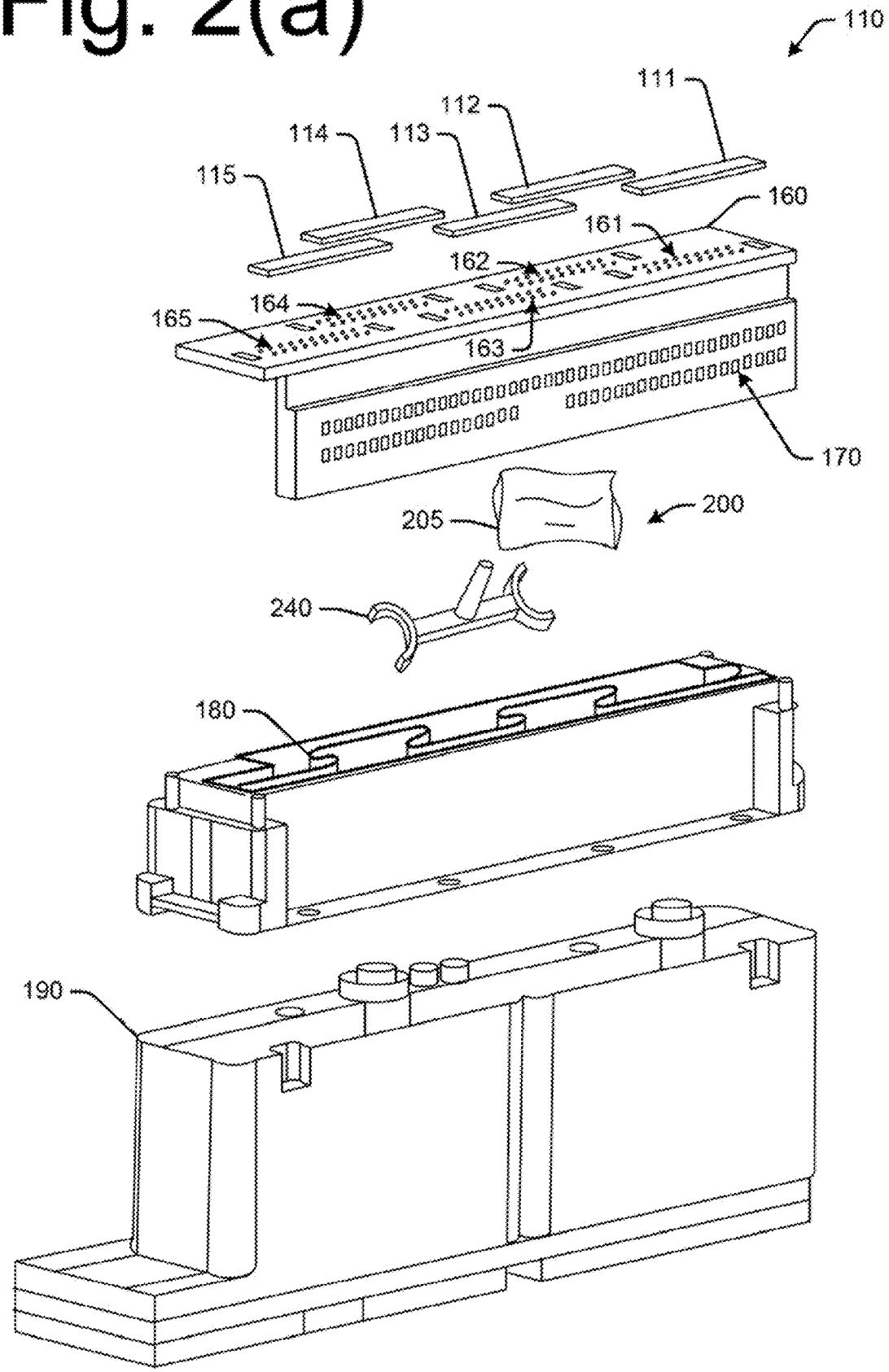
FIG. 2*a* is an exploded perspective view of the example print head shown in FIG. 2.

FIG. 2 is a perspective view showing the example print head 116 in more detail. FIG. 2*a* is an exploded perspective view of the example print head 110 shown in FIG. 2. Example print head 110 includes the print dies 111-115 mounted on a circuit board 160. The circuit board 160 enables electrical connection to activate the print dies 111-115 during a printing operation.

Electrical contacts 161-165 can be seen on the circuit board 160 in FIG. 2*a* corresponding to each of the print dies 111-115. The electrical connections 161-165 are electrically connected to corresponding electrical pads 170. When the print head 110 is inserted into a printer system 100 (e.g., the printer system 100 shown in FIG. 1), the electrical pads form an electrical connection between the print dies 111-115 and the printer controller (discussed above for FIG. 1). During a print operation, electrical signals are used to "fire" corresponding nozzles on the print dies and eject ink from the ink reservoir 180 onto the print media 120 in the desired pattern. Ink reservoir 180 may be assembled to print head body 190.

The print head 110 includes a compliant element 200. In an example, the compliant element 200 is a sealed bag filled with air or other gas (or gas mixture), and inserted into the ink reservoir 180. The compliant element 200 may be entirely contained within the ink volume. It is noted that one or more compliant element 200 may be disposed within each ink reservoir.

FIGS. 3*a-f* illustrate assembly and installation of an example compliant element 200 in the print head 110. The compliant element 200 may be formed as an air or gas filled bag. Materials used to manufacture the bag may have a high compatibility with many inkjet fluids. It is noted that the bag does not have to be located in immediate proximity to the drop ejection nozzles. As such, there is more design flexibility in the print head geometry and the fluidic path. There is no constraint on the nozzle packing density.

According to an example assembly process, top and bottom layer films 210*a-b* (layered one on top of the other) are first tacked to a die 220 as shown in FIGS. 3*a-b*. Next, the films are fastened together such that a volume of gas is captured between the films when the bags 230 are sealed, as shown in FIG. 3*b* after being removed from the die 220. The resulting gas-filled bags 205 are best seen in the side view shown in FIG. 3*d*.

The films 210*a-b* may be fastened together using any suitable process. An example uses heat staking (e.g., the films 210*a-b* are staked in area 232 and 234 on the die 220). Fastening of the films can also be accomplished with glue, mechanical clip or other device, so that the air or gas filling does not leak out during use, and/or so that the ink fluid does not permeate into the bag during use. It is noted that the compliant element is not limited to any particular method of manufacture, and does not need to be heat-staked. Indeed, as described herein, the compliant element is not limited to any particular type or configuration of structure and does not need to be implemented as a gas-filled bag.

Figure 3:
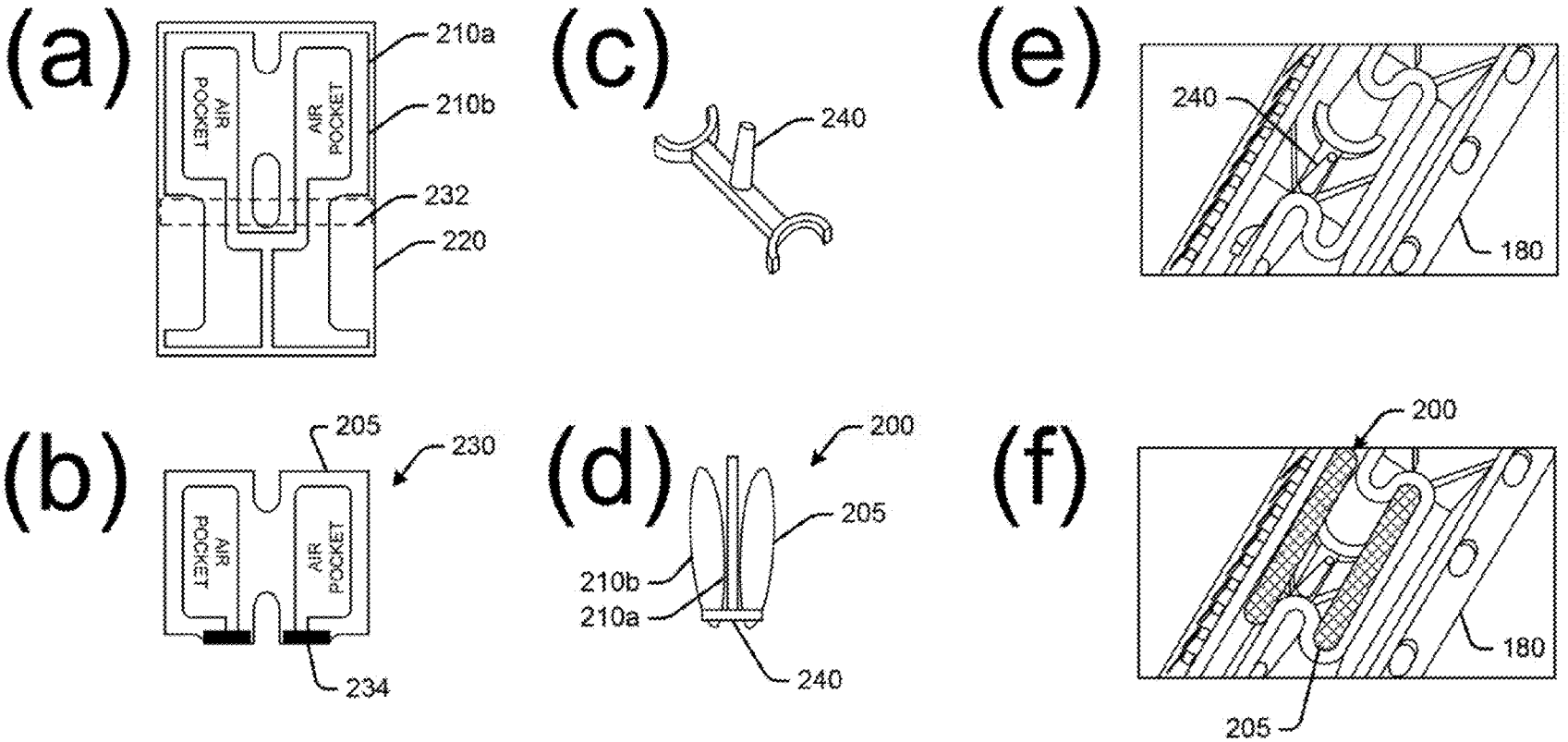
FIGS. 3*a-f* illustrate assembly and installation of an example compliant element in a print head.

The perimeter of the films 210*a-b* is shown in FIG. 3 having a generally rectangular shape, thus forming generally rectangular or oval shaped bags 205. It is noted, however, that the formed bag can be any shape, including but not limited to circular, oval, rectangular, peanut, and other shapes. The shape may be varied based on the perimeter of the films tacked to the die. The shape can also be varied based on an internal structure, as explained in more detail below.

In addition, the compliant element 200 may be manufactured with a single layer or be made of multiple layers of film. Each film layer may have a different function. For example, functions may include but are not limited to reducing vapor transmission, providing strength, allowing fastening to another film, and tying the multiple layers together. The films can be any combination of non-rigid and rigid materials with the same or different mechanical properties. Construction of each film is typically one of multiple layers.

The bag may be filled with any suitable gas, including air or other gas or gas mixture. In other examples, a liquid and/or liquid-gas combination may also be utilized. The gas should be selected having a molecular weight that provides a generally slow diffusion rate of both the gas out through the film, and the ink in through the film. The bag(s) can be filled with any volume of gas relative to maximum inflation.

Variations are also contemplated. Design considerations may include the compliant element 200 having sufficient surface area to achieve the intended benefit (e.g., the "capacitive" effect). In addition, the materials may be selected to be chemically compatible with the ink fluid in the print head, e.g., to avoid introducing negative performance issues.

In another example, the compliant element may itself take the form of a curable substance, such as an adhesive. For example, the substance may be a cured or partially cured adhesive such as thermally cured one or two-part silicone or silicone-based product. It is noted, however, that the substance may have any composition such that the adhesive itself (or in combination with other structure) provides the capacitive effect. In an example, the substance is a flexible, low modulus substance.

The substance may be pre-formed and/or take any suitable shape during the assembly process. For example, injection molding may be used. The substance can be injected and cured prior to assembly of the printhead. The uncured substance is dispensed to cover the full length of the wall opposite the printing nozzles. This is described as the 'ceiling' of the ink manifold in a nozzle-down printing orientation. The substance can then be cured prior to assembly of the printhead In an example, the substance may be adhered directly to the sidewalls inside the ink reservoir 180. Accordingly, the substance can be very thin, while still occupying a large area. The substance (e.g., being an adhesive) may also be adhered using itself as the adhesive and/or another adhesive. The substance may be adhered to additional features and can also be added to internal portions of the print head body to retain or constrain the flow of the adhesive prior to curing. In another example, the substance may be press-fit into place without any adhesive (e.g., the substance is held in place by a friction or interference fit).

The compliant element may also be a gel or gel-like substance. In another example, the compliant element may be a foam substance, such as a closed-cell foam. The foam may be fully contained within the ink containment boundary. It is noted coatings may be applied to reduce the gas and liquid transmission rate through the compliant element, particularly where the compliant element is an open or partially open structure.

The foam may take any shape, and can be formed for example using cord extrusion, box extrusion, or cut from bulk, to achieve an insert shape such as cylinder, block, sphere, etc. The compliant surface area of the assembly may be sufficient to achieve the intended "capacitive" benefit. Any material or blend of materials can be used, such as silicone, EPDM, nitrile, neoprene, and other materials. Again, the materials may be selected to be chemically compatible with the fluid (e.g., ink in the print head) to avoid introducing other performance issues. One or more separate assemblies may be inserted within each volume of ink.

The compliant element may be mounted to a clip, such as the attachment member 240 (shown for attached the bag in FIGS. 3*c-d*) and inserted into the ink reservoir 180. Mounting in the ink reservoir 180 is shown by the partial top perspective views shown in FIGS. 3*e-f*. The top perspective view in FIG. 3*e* shows the attachment member 240 inserted in the ink reservoir 180. The top perspective view in FIG. 3*f* shows the bags on the attachment member 240 in the ink reservoir 180.

Other securement means may also be used, including the use of additional attachments or connections. It is noted that the compliant element need not be connected inside the ink reservoir 180. In another example, the compliant element may be wedged in the ink reservoir 180. In yet another example, the compliant element may be free-floating.

In addition to the benefits already described above, the compliant element may also be used to reduce bubble gulping and/or localized nozzle de-prime (each of which can also cause print defects). Bubble gulping occurs when bubbles are present in the ink reservoir, and those bubbles make their way to the print head. Nozzle de-prime occurs when the print head experiences a sudden mechanical shock, for example, during intended events such as servicing, wiping, or capping, and/or during an unintended event such as a paper crash, or machine bump. The compliant element can provide a "capacitance" effect to help reduce the effects during printing operations.

It is noted that if the gas leaves the bags due to diffusion, potentially until all the gas is depleted, the bag may collapse and the assembly may no longer function as intended. Accordingly, an internal member may be used to provide a resistive force to the diffusion of gas out through the bag assembly. The internal member helps to prevent the bag 205 from collapsing, and thereby maintains the compliance properties of the bag 205. The internal member may be configured as a support structure (e.g., an object provided inside the bag 205) or as a frame (e.g., a skeleton provided inside the bag 205).

Figure 4:
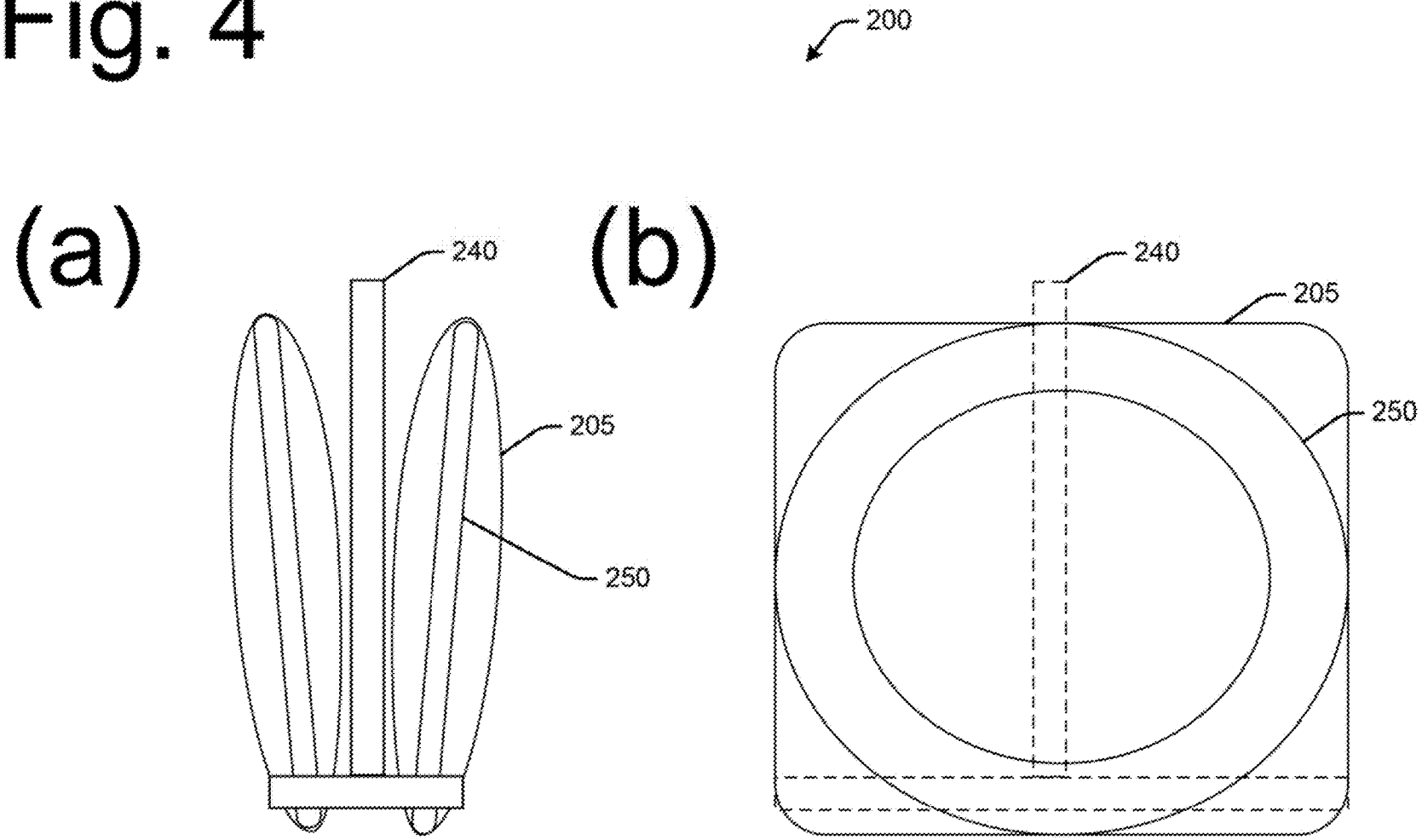
FIGS. 4*a-b* show an example internal member of the compliant element.

FIGS. 4*a-b* show an example internal member configured as a support structure 250, wherein (a) is a front plan view and (b) is a side plan view. The support structure 250 may be a separate structure provided inside the bag 205, such as the washer or ring shown in the drawing. The support structure 250 serves to maintain an unconstrained surface area throughout the useful life of the bag 205.

The support structure 250 may be a rigid or semi-rigid structure inserted within the bag, such as but not limited to a tube, a box, a square, a dome, a sphere, and a ring. The support structure 250 may also be a foam structure, such as a closed-cell foam, an open-cell foam, or a solid foam. The shape of the support structure 250 may take any shape. Design considerations for selecting a shape include maintaining a compliant surface of the bag, even after complete collapse of the bag 205.

In another example, the support structure 250 can be flexible with the rigidity provided by the design of the assembly itself. An example of a flexible support structure is an internal (inflated) bag provided inside the bag 205. The internal bag may be filled with a gas having a low vapor transmission rate. In addition, the internal bag need not be compatible with the fluid in the device because it is protected by the external bag 205. For example, a metalized bag can be used as the internal bag, even though the metalized bag may otherwise corrode in the presence of ink.

Figure 5:
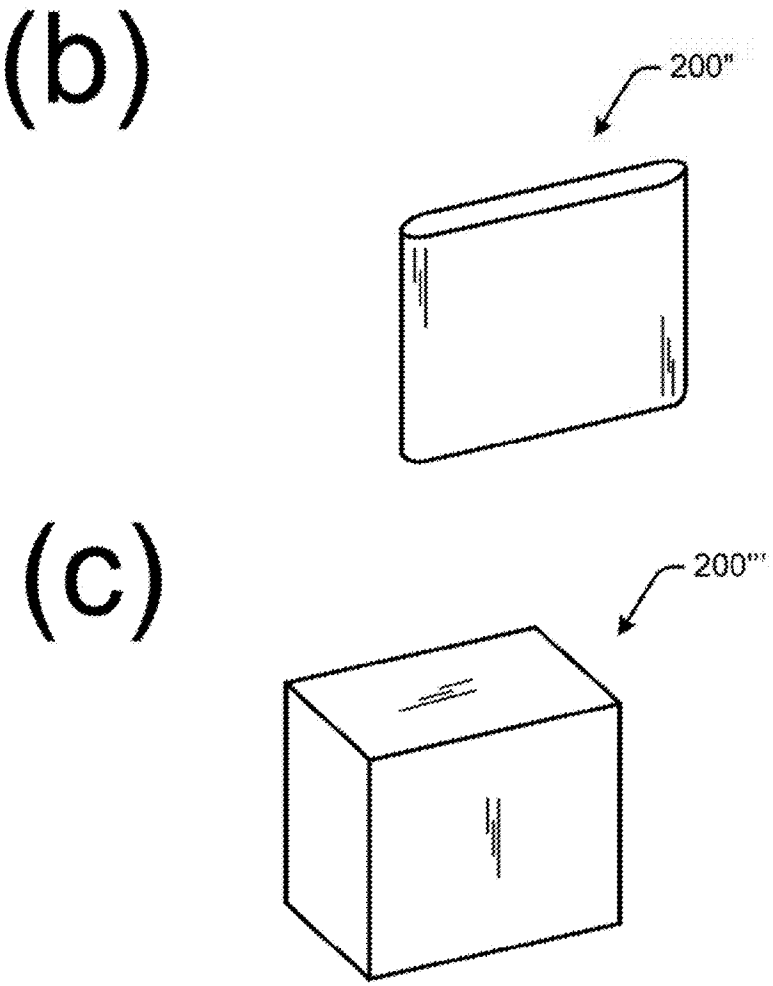
FIGS. 5*a-c* are perspective views of other examples of the compliant element.

FIGS. 5*a-c* are perspective views of other examples of the compliant element. In FIG. 5*a*, the compliant element 200' is configured as a frame 260. The frame 260 may be provided to maintain unconstrained surface area of the bag 205' throughout the useful life of the bag 205. The frame 260 may be molded, extruded, machined, or formed. Example frames may be made from hollowed tube(s), a mesh material, or coil(s). By way of illustration, the frame 260 is a drum, and a film or other flexible material is secured over or around the drum.

The drum may be formed from film 265 fastened on opposite ends 262*a-b* of a rigid, hollow cylinder, capturing a volume of gas therein. Films are fastened to the frame 260 using heat staking. Fastening can also be accomplished with glue, mechanical clip or other device, so that air does not leak out during use and/or ink fluid does not transgress into the drum. The drum may be formed using a single film fastened, or multiple films on a multi-sided shape.

In FIGS. 5*b-c*, the compliant element is a flexible, low modulus substance. In FIG. 5*b*, the compliant element 200" is a molded adhesive substance, e.g., shaped to conform with one of the interior chambers of the ink reservoir. In FIG. 5*c*, the compliant element 200''' is a foam structure. For example, a closed-cell foam block is shown for purposes of illustration, but any foam structure can be used. The adhesive substance and closed cell foam have already been described above and therefore the description is not repeated here.

In addition to the benefits already described above, the compliant element is fully contained within the ink containment boundary. As such, the ink flux correction does not risk fluidic integrity of the print head, upon any failure of the print head element. This method of ink flux correction also delivers performance robustness through redundancy. That is, multiple bags (or other compliant element or combination of compliant elements) can be inserted during assembly, each acting independently. If one bag fails, the other bag(s) still provide ink flux correction. This serves to both increase the capacitive benefit, while also providing redundancy in the event of a bag assembly failure.

The operations shown and described herein are provided to illustrate examples of ink flux correction in a print head. It is noted that the operations are not limited to any particular ordering. Still other operations may also be implemented.

The examples shown and described herein are provided for purposes of illustration and are not intended to be limiting. Still other embodiments are also contemplated.

The invention claimed is:

1. A fluid ejection device with fluid flux correction, comprising:

a fluid reservoir;

ejection nozzles; and a compliant element located in the fluid reservoir in a fluidic path in proximity to the ejection nozzles, the compliant element absorbing fluid surges caused by variations in fluid flux during operation of the ejection nozzles to reduce distortion of at least one nozzle meniscus and maintain consistent drop ejection.

2. The fluid ejection device of claim 1, wherein the compliant element is a flexible, low modulus substance.

3. The fluid ejection device of claim 1, wherein the compliant element is a gas filled bag sealed to retain the gas within the bag.

4. The fluid ejection device of claim 3, wherein the gas has a molecular weight sufficient to reduce or prevent diffusion of ink into the compliant element and migration of the gas out of the compliant element.

5. The fluid ejection device of claim 1, further comprising a support structure within the compliant element, the support structure providing outward resistance to fluid adjacent the compliant element.

6. The fluid ejection device of claim 1, wherein the compliant element comprises an internal frame supporting an outer film in a predetermined shape.

7. The fluid ejection device of claim 6, wherein the predetermined shape of the film is a box or a drum.

8. The fluid ejection device of claim 6, wherein the internal frame is a hollowed tube, box, mesh, coil, dome, sphere, square, or ring.

9. The fluid ejection device of claim 1, wherein the compliant element is foam.

10. The fluid ejection device of claim 1, further comprising an attachment member connecting the compliant element inside the fluid reservoir.

11. The fluid ejection device of claim 1, wherein the compliant element is fully contained within a fluid containment boundary of the fluid reservoir.

12. The fluid ejection device of claim 1, wherein the ejection nozzles are provided on a fluid ejection die, and the compliant element extends substantially parallel with a longitudinal axis of the fluid ejection die.

13. A method of fluid flux correction, comprising:

providing a compliant element in a fluid reservoir, in a fluidic path in proximity to ejection nozzles, to displace a fluid volume in the fluid reservoir and absorb fluid surges caused by variations in fluid flux during operation of the ejection nozzles to reduce distortion of at least one nozzle meniscus and maintain consistent fluid ejection.

14. The method of claim 13, further comprising fully containing the compliant element within a fluid containment boundary of the fluid reservoir.

15. The method of claim 13, further comprising capturing a volume of gas within the compliant element.

16. The method of claim 13, further comprising maintaining drop characteristics during fluid ejection independent of variations in fluid flux.

17. The method of claim 13, further comprising adhering the compliant element to the fluid reservoir.

18. The method of claim 13, further comprising extending the compliant element a length of a longitudinal axis of a fluid ejection die having the ejection nozzles formed therein.

* * * * *

UNITED STATES PATENT AND TRADEMARK OFFICE

CERTIFICATE OF CORRECTION

PATENT NO. : 9,221,266 B2
APPLICATION NO. : 14/371952
DATED : December 29, 2015
INVENTOR(S) : Benjamin H. Wood et al.

It is certified that error appears in the above-identified patent and that said Letters Patent is hereby corrected as shown below:

Title Page, item (73), Assignee, delete "Parkard" and insert -- Packard --, therefor.

Signed and Sealed this
Thirty-first Day of May, 2016

Michelle K. Lee

Michelle K. Lee
*Director of the United States Patent and Trademark Office*